US008992394B2

(12) United States Patent
Mitchell et al.

(10) Patent No.: US 8,992,394 B2
(45) Date of Patent: Mar. 31, 2015

(54) BARBELL SUPPORT

(76) Inventors: Kerry Mitchell, Virginia Beach, VA (US); Eric Jordan, Virginia Beach, VA (US)

( * ) Notice: Subject to any disclaimer, the term of this patent is extended or adjusted under 35 U.S.C. 154(b) by 313 days.

(21) Appl. No.: 13/011,170

(22) Filed: Jan. 21, 2011

(65) Prior Publication Data

US 2011/0183818 A1 Jul. 28, 2011

Related U.S. Application Data

(60) Provisional application No. 61/297,020, filed on Jan. 21, 2010.

(51) Int. Cl.

| | |
|---|---|
| ***A63B 21/078*** | (2006.01) |
| ***A63B 21/06*** | (2006.01) |
| ***A63B 71/00*** | (2006.01) |
| ***A63B 21/072*** | (2006.01) |

(52) U.S. Cl.

CPC ..... *A63B 21/0724* (2013.01); *A63B 71/0036* (2013.01); *A63B 21/078* (2013.01)

USPC ..... 482/104; 482/93

(58) Field of Classification Search

USPC ..... 482/97, 104, 106, 108, 132, 92–96, 482/98–103, 105, 107, 109

See application file for complete search history.

(56) References Cited

U.S. PATENT DOCUMENTS

| | | | | |
|---|---|---|---|---|
| 4,477,074 | A * | 10/1984 | Bushnell | 482/108 |
| 4,773,642 | A * | 9/1988 | Cruz | 482/104 |
| 5,487,712 | A * | 1/1996 | Kann | 482/97 |
| 5,575,742 | A * | 11/1996 | Wu | 482/92 |
| 6,350,221 | B1 * | 2/2002 | Krull | 482/142 |
| 6,645,130 | B2 * | 11/2003 | Webber | 482/142 |
| 7,955,223 | B1 * | 6/2011 | Gilman | 482/14 |
| 2002/0098954 | A1 * | 7/2002 | Buechel et al. | 482/96 |
| 2005/0164850 | A1 * | 7/2005 | Leibowitz | 482/93 |
| 2007/0082795 | A1 * | 4/2007 | Murray et al. | 482/104 |
| 2009/0305851 | A1 * | 12/2009 | Sukup | 482/104 |
| 2010/0022362 | A1 * | 1/2010 | MacDonald | 482/94 |

FOREIGN PATENT DOCUMENTS

| | | | |
|---|---|---|---|
| FR | 2659560 | A1 * | 9/1991 |
| JP | 07299160 | A * | 11/1995 |

* cited by examiner

*Primary Examiner* — Loan H Thanh
*Assistant Examiner* — Gregory Winter
(74) *Attorney, Agent, or Firm* — Pike IP Law, PLLC; Bernard G. Pike

(57) ABSTRACT

A barbell support safely assists with adding and removing weight plates between exercises. The barbell support provides leverage and stability for manipulating weight plates on the barbell. An embodiment of the barbell support has at least one cradle, a leverage handle, and at least one pivot foot. The cradle or cradles are capable of supporting and balancing a barbell. The cradles may be tilted forward using the leverage handle to lower the cradle below the height of the barbell comprising weight plates.

4 Claims, 8 Drawing Sheets

BARBELL SUPPORT

RELATED APPLICATIONS

This patent application claims priority to U.S. Provisional Patent Application Ser. No. 61/297,020 filed on Jan. 21, 2010 which is hereby incorporated by reference.

FIELD OF THE INVENTION

The invention is directed to a device for lifting and supporting a barbell. The barbell support assists in safely removing or adding weight plates.

BACKGROUND

Proper weightlifting technique requires frequent changing of weight plates between sets and types of exercises. For example, each set of a particular exercise may require several weight plate changes. For example, it is recommended that at the beginning of each set of a weightlifting exercise that a weightlifter should do a couple of sets with lighter weights prior to working up to the final target weight for the lift. For instance, if the goal is to perform six to ten repetitions of a squat with 450 lbs. of weight plates on the barbell, the weightlifter should warm up with sets of squats with lighter weights first. For example, the weightlifter should perform eight to twelve repetitions with 200 lbs., then another eight to ten repetitions with 350 lbs. and, finally, the goal of six to eight repetitions with 450 lbs. may be performed. Proper weightlifting technique requires such a warm up process, however, weightlifters often do not perform the proper warm up repetitions because it is inconvenient and difficult to add and remove weight plates.

In addition, it is difficult to safely remove the weight plates from a barbell when weightlifting alone. The weightlifter must lift the bar onto a rack or lift one end while attempting to slide the plate off the bar. This results in awkward lifting positions and potential injury. Even minor injuries may prevent a weightlifter from performing his desired exercises and reaching his goals. Therefore, there is a need for a barbell support that assists in lifting a barbell off the floor to allow the plates to be removed or added safely and easily.

SUMMARY

The invention is directed to a barbell supports and methods of lifting a barbell. An embodiment of the barbell support comprises at least one cradle, a leverage handle, and at least one pivot foot. The cradle or cradles are capable of supporting and balancing a barbell. The cradle may be supported at a height above the floor that is greater than or equal to the radius of the weight plate on the barbell or a weight plate to be added to the barbell. In certain embodiments, the cradles are typically supported at a height between the radius of the weight plate and the diameter of the weight plate. In other embodiments, the cradles may be supported at a height above the floor equal to the radius of the largest typical weight plate and the 1.5 times the radius of that weight plate.

The cradles may be tilted forward using the leverage handle to lower the cradle below the height of the barbell comprising weight plates. The leverage handle may then be pulled back to lift the barbell onto the pivot foot supported by the cradles. The weight plates are thus lifted off the floor and may be more easily removed from the barbell. In further embodiments, the barbell support comprises a leverage handle having a handle portion and at least one support foot portion. Embodiments of the barbell support comprise a leverage handle that is capable of providing a mechanical advantage in the range of 2 to 10 for lifting a weight in the cradle.

Further embodiments include a method of removing a plate on a barbell, comprising sliding a cradle under a barbell comprising a weight plate, wherein the weight plate is resting on a floor, leveraging the cradle with a handle attached to the cradle to raise the weight plates off the floor, and removing the weight plate from the barbell.

In a still further embodiment, the barbell support for changing weight plates may comprise at least three feet defining a footprint, a leverage arm, a cradle for supporting a barbell such that the center of gravity of the barbell is above the footprint.

Other aspects and features of embodiments of the barbell support will become apparent to those of ordinary skill in the art, upon reviewing the following description of specific, exemplary embodiments of the present invention in concert with the figures. While features may be discussed relative to certain embodiments and figures, all embodiments can include one or more of the features discussed herein. While one or more particular embodiments may be discussed herein as having certain advantageous features, each of such features may also be integrated into various other of the embodiments of the invention (except to the extent that such integration is incompatible with other features thereof) discussed herein. In similar fashion, while exemplary embodiments may be discussed below as system or method embodiments it is to be understood that such exemplary embodiments can be implemented in various systems and methods.

DESCRIPTION OF EMBODIMENTS

Figure 1:
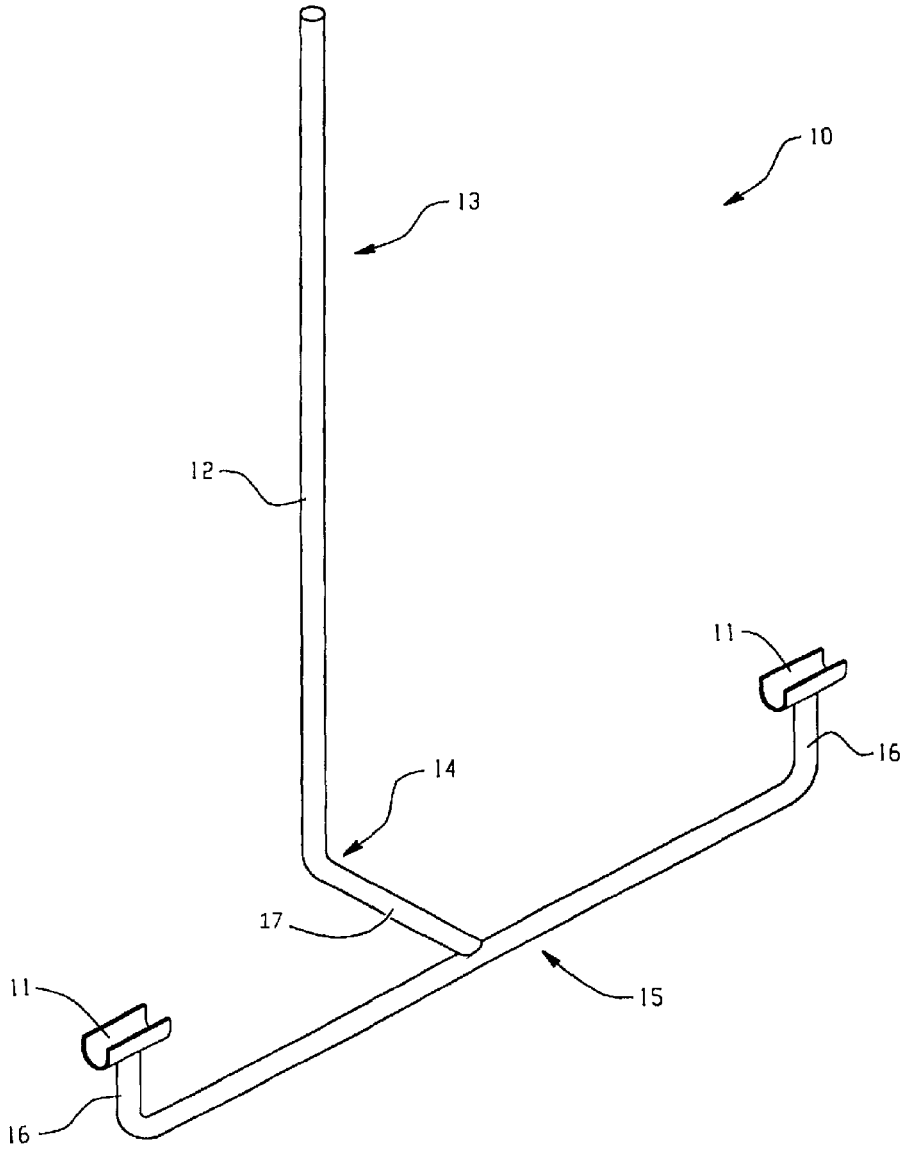
FIG. 1 depicts an embodiment of the barbell support capable of easily lifting a barbell for manipulation of weight plates.

A barbell is a versatile piece of exercise equipment used in weight training, weightlifting and/or powerlifting. Barbells are typically cylindrical metal bars capable of receiving one or more sets of weight plates and may comprise a set of collars to secure the weight plates onto the barbell. Barbells typically range in length from 4 feet to 7 feet. A typical barbell may be described as having three sections, a central section used for lifting the barbell and two outer sections used for holding weight plates. The central portions of various barbells may vary in diameter, but are usually close to one inch in diameter and may have a knurled crosshatch pattern to provide a stronger non-slip grip. Weight plates may be slid onto the outer sections of the bar to obtain the desired total weight desired for a particular exercise. The weight plates may then be secured with collars to prevent them from sliding off the barbell during the exercise. If the barbell is placed on the floor, the barbell is supported off the floor by resting on the perimeter of the weight plates.

Additionally, there are Olympic barbells or weightlifting barbells wherein the outer sections comprise sleeves that are able to rotate relative to the central portion. The rotating sleeves allow the weight plates to rotate about their central axis during use. Rotating weight plates reduce or eliminate the rotational-inertia effect placed upon the body of the weightlifter during quick movement of heavy weights during lifting and enables the lifter to move under the bar more easily without additionally rotating all the weight on the barbell.

A men's Olympic bar is typically 7.22 feet long and weighs about 44 lbs. The outer portions are approximately 2 inches diameter, while the central section is about 1.25 inches. The total weight of the barbell varies based on the type and number of plates loaded onto the outer portions of the bar; adding and/or removing weight and moving a highly loaded barbell presents difficulties. A women's Olympic bar is similar to the men's bar, but is shorter approximately 6 feet and weighs 33 lbs. with a thinner, typically, one inch central section.

Figure 1A:
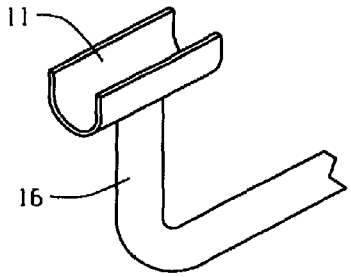
FIGS. 1A, 1B, 1C, 1D, 1E and 1F depict various cradles for embodiments of the barbell support.
Figure 1D:
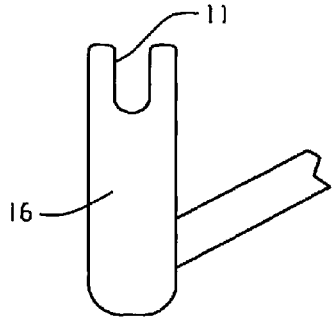
Figure 1B:
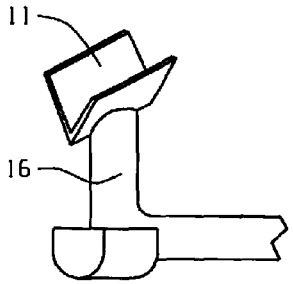
Figure 1E:
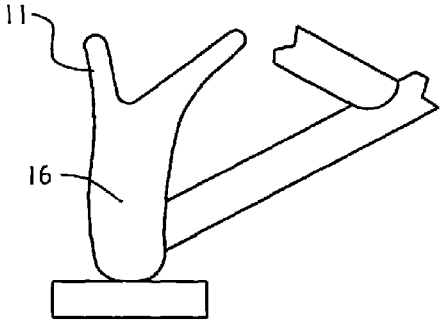
Figure 1F:
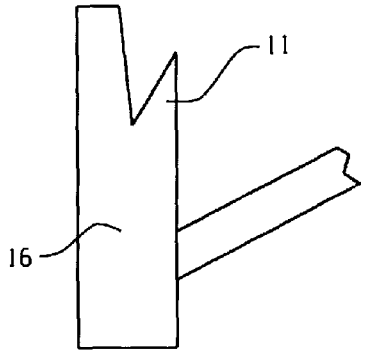
Figure 2A:
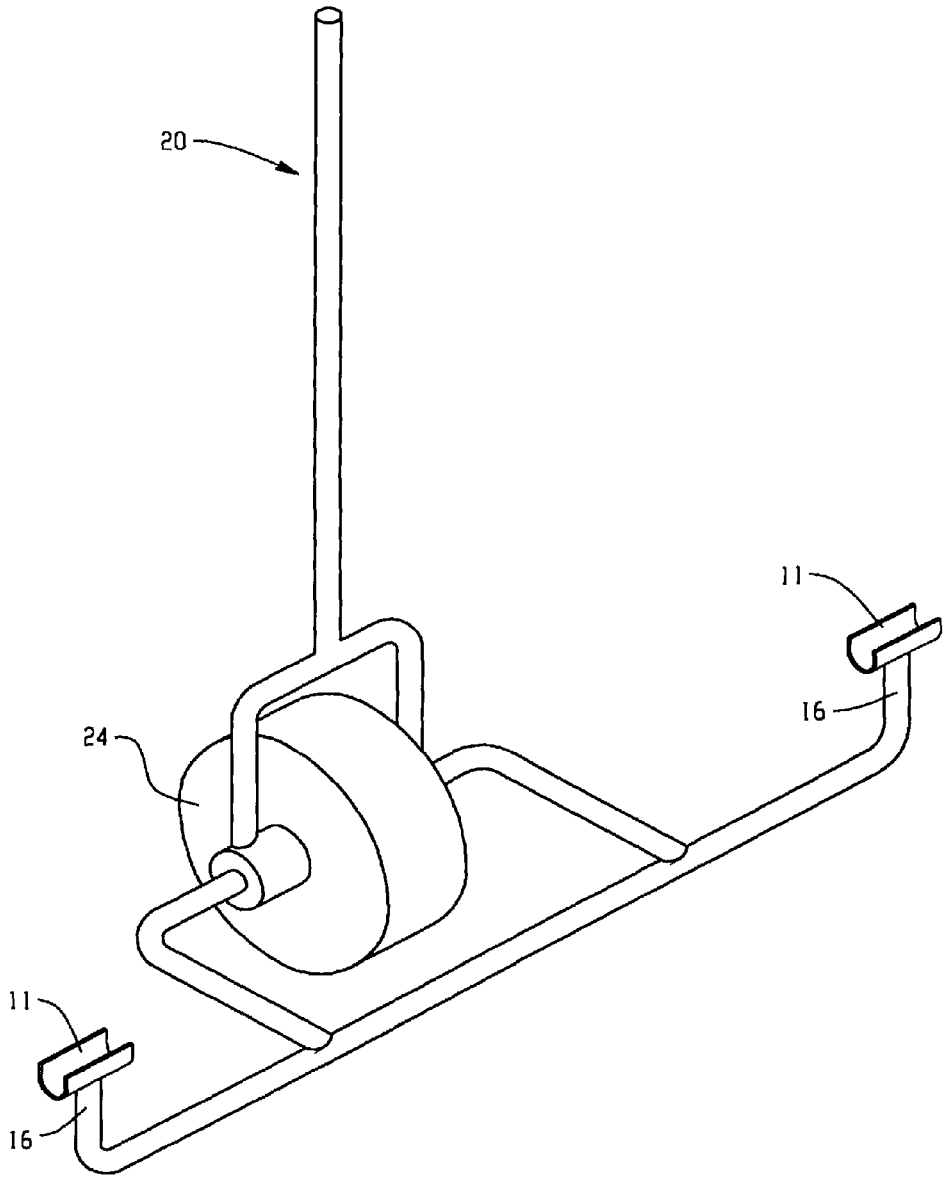
FIGS. 2A and 2B depict embodiments of the barbell support comprising wheels.
Figure 5:
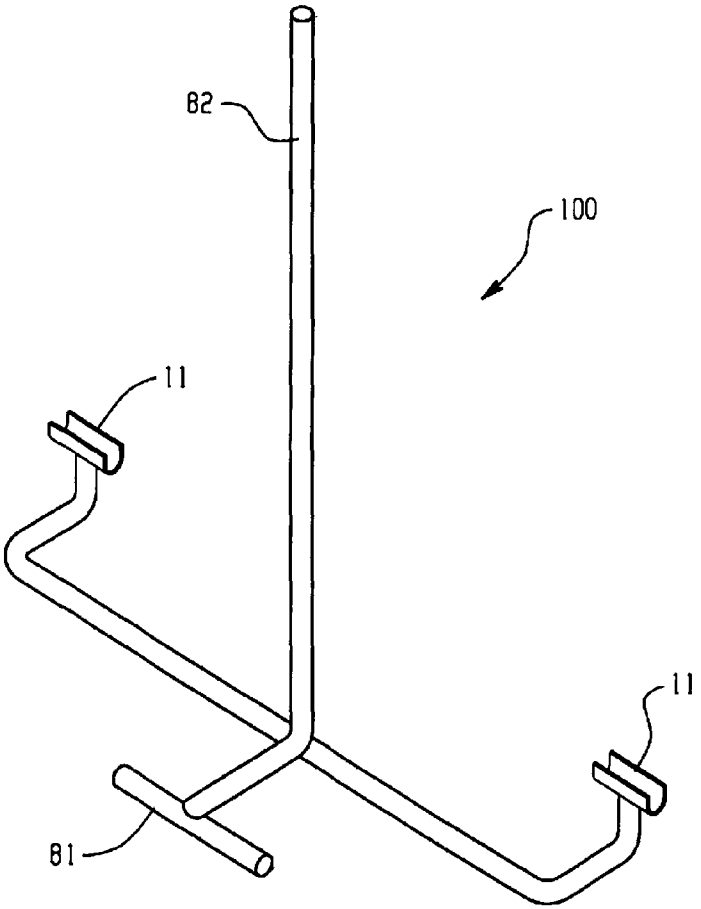
FIG. 5 depicts an embodiment of the barbell support comprising a foot pedal for stabilizing and assisting in lifting the barbell.

An embodiment of the barbell support comprises at least one cradle, a leverage handle, and at least one pivot foot. The embodiment of barbell support 10 in FIG. 1 comprises two cradles 11. The cradle of the barbell support is capable of supporting and balancing a barbell while resting on the barbell support. The cradle may have a U-shaped cross-section (as shown in FIGS. 1A and 1D, for example), a V-shaped cross-section (as shown in FIGS. 1B and 1F, for example), J-shaped cross-section (as shown in FIG. 1E), or any other shape capable of receiving and supporting the barbell. The barbell support may comprise only one cradle (as shown in FIGS. 3A, 3B, 3C and 4, for example) or more than one cradle (as shown in FIGS. 1, 2A, and 5, for example). The cradle or cradles should be positioned such that they safely support the barbell in its central portion to avoid interfering with adding or removing of the weight plates. The cradle should also be long enough to remain balanced even when one side of the barbell has weight plates and the other side is not loaded. The cradle may be lowered by pivoting the barbell support forward on the pivot foot. The cradle may be positioned adjacent and below the barbell resting on the perimeter of the weight plates. The leverage arm may be pulled back again pivoting the barbell support on the pivot foot to raise the cradles and the barbell with weight plates. With the weight plates not resting on the floor, the plates may be easily manipulated.

The barbell support may also comprise a cradle height adjustment feature that allows the cradle to support the barbell at different heights and to be more easily lowered under the barbell at different heights. It may be desirable to adjust the height of the cradle or cradles based upon the diameter of the weights to be supported. It certain embodiments, it would be sufficient to only support the weights slightly off the floor to reduce the distance that the barbell would need to be lifted and reduce the distance that the weight must be moved when removed from the barbell. The cradle height adjustment may be incorporated in the cradle or cradle support leg or incorporated in at least one foot on the barbell support. The adjustment feature may comprise a threaded connection that may be rotated to adjust the height of the cradle, may comprise a cradle or cradle support with multiple holes that allow a pin to support the cradle at multiple heights, may comprise a variety of cradle supports of different height that may be connected to the barbell support to allow the cradle to be supported at different heights, or any other mechanism capable of allowing adjustment of the cradle support.

The embodiment of the barbell support shown in FIG. 1 also comprises a leverage handle 12. The leverage handle 12 reduces the amount of force needed to lift the barbell and weight plates. In certain embodiments of the barbell support, the leverage handle comprises a handle portion 13 and a support foot portion 14. The support foot portion on the leverage handle supports the barbell support in the upright position when supporting a barbell or when not in use.

The embodiment of the barbell support of FIG. 1 further comprises a pivot foot 15 and a floor engaging leg 17 extending between the support foot portion 14 and the pivot foot 15. The barbell support may be pivoted on the pivot foot 15 to ease loading of the barbell onto the support. The cradles 11 may be pivoted under a barbell. For example, the leverage handle 12 may be pushed forward causing the barbell support 10 to be pivoted on the pivot foot 15. As the barbell support 10 is pivoted forward, the cradles 11 are lowered until the cradles 11 may be slid under the barbell. The leverage handle 12 may then be pulled backward to raise the cradles 11 so that the cradles 11 surround a portion of the barbell. As the leverage handle 12 is pulled further backward, the cradles 11 lifts the barbell until the support foot portion 14 is resting on the floor. The length of the leverage handle relative to the height of the cradles 11 above the pivot foot 15 determines the mechanical advantage provided by the barbell support 10 for lifting the barbell and any weight plates that may be on the barbell. In certain embodiments, the leverage handle may provide a mechanical advantage in the range of 2 to 10 for lifting a weight in the cradle. In the embodiment of the barbell support of FIG. 1, the cradles 11 are attached to pivot foot 15 by support legs 16. The support legs 16 should be long enough to support the cradle 11 at a height that is greater than the radius of the biggest weight plate to be used on the barbell. For example, a typical 25 kilogram Olympic weight plate has a radius of about 8.8 inches (450 mm). Therefore, a support surface of the cradles should be greater than 8.8 inches (450 mm) higher than the bottom of the pivot foot. Preferably, the height of the cradle should be at least an inch greater than the diameter of the largest weight plate to be added or removed from the barbell support. In some embodiments, the height of the cradle may be adjustable. Therefore, embodiments of the barbell support comprise an adjustable cradle height. The cradle height may be adjustable by any means that would allow adjustment but still be sufficiently strong to support the desired weight. The support legs 16 may comprise two pieces that may be adjusted to change the overall length of the support legs 16 and, therefore, the cradle height. The support legs may comprise holes and a pin wherein the choosing and aligning a particular hole and insertion of the pin will determine the overall length of the support leg. In another embodiment, the support leg may comprise two parts connected by a threaded connection. In such an embodiment, rotating one part relative to the other part will adjust the length of the support leg. Further embodiments of the barbell support may comprise a set of support legs and/or cradles. In such an embodiment, the desired height can be determined and chosen from the set of support legs and/or cradles. The support legs may be labeled for use with a corresponding weight size. Various other mechanisms and means for adjusting may also be incorporated into embodiments of the barbell support.

Figure 1C:
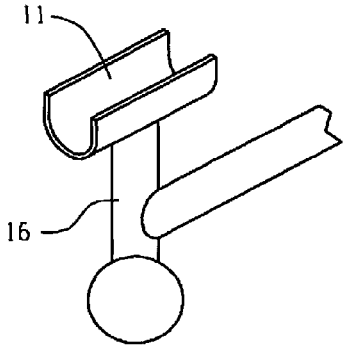
Figure 6:
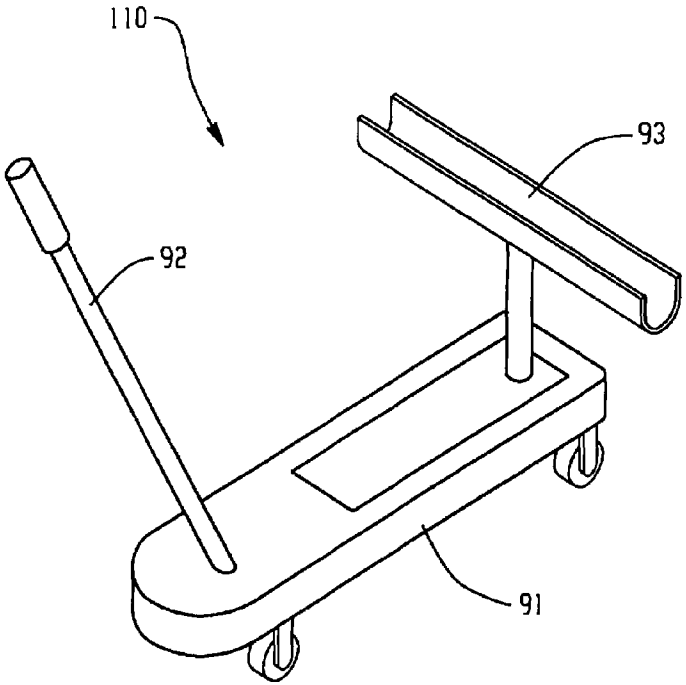
FIG. 6 depicts an embodiment of the barbell support comprising a hydraulic jack to assist in lifting and moving the barbell, the hydraulic jack may be used to lift the barbell to different heights.

The pivot foot may comprise a rounded bottom, as shown in FIGS. 1B and 1C, for example. The bottom of the pivot foot 15 may include a resilient, nonslip cover or coating to prevent the barbell support from sliding as the barbell support is moved or in use and/or to prevent damage to the floor. Further, the pivot foot may comprise at least one wheel. The pivot foot may comprise multiple wheels. See for example, FIGS. 6A and 6B, for example. Any or all of the wheels may comprise a brake, as known in the art, that prevents the barbell support from rolling or sliding as the barbell support is used to lift the barbell. However, the wheels may be unlocked and allow the barbell to be more easily moved to another location.

Figure 2B:
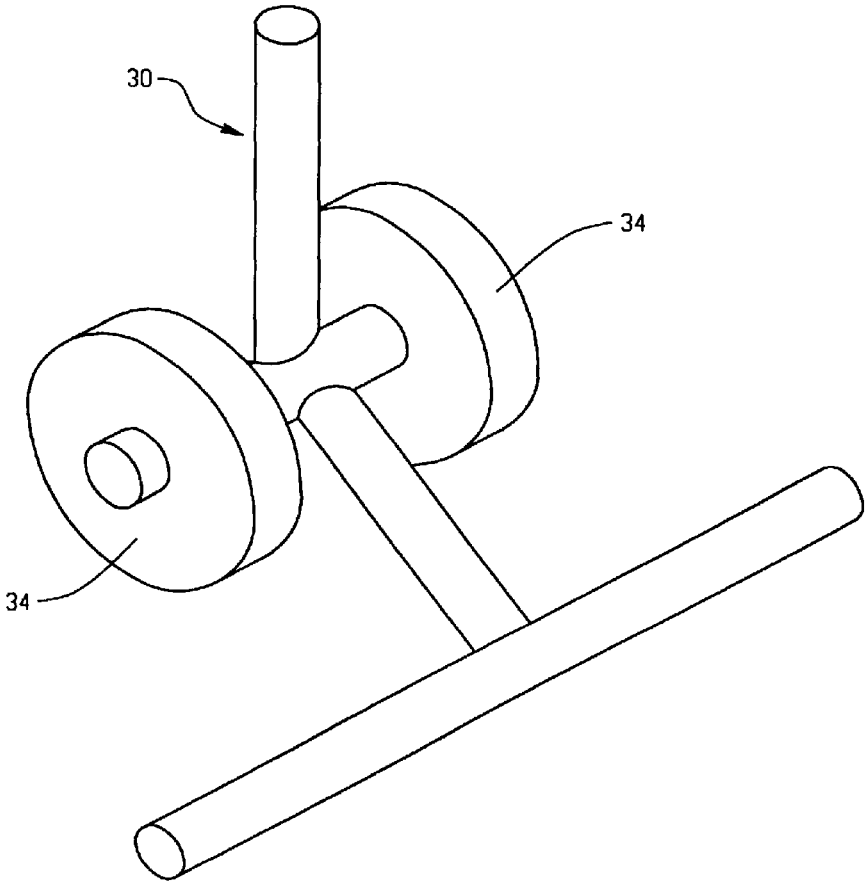

In certain embodiments, the barbell support comprises a leverage handle. The leverage handle 12 may comprise a handle portion 13 and a support foot portion 14. The support foot portion 14 is capable of providing a further foot for the barbell support 10 to rest on and provide stability. Thus, a further embodiment, the barbell support may comprise at least three feet defining a footprint of the barbell support, a leverage arm, and a cradle for supporting a barbell such that the center of gravity of the barbell is above the footprint. The foot portion of the leverage handle may be any known foot design (such as the feet shown in FIGS. 1A, 1B, and 1C) or may be a wheel or wheels as shown in FIGS. 2A and 2B. The wheels 24 34 may comprise a rotation lock such that the wheel(s) may be free to rotate or be locked in a stationary position. In a locked position, the wheels 24 34 will not rotate and the barbell can be safely lifted and supported by the barbell support 20 30 during adding or removing weight plates. In the unlocked position, the wheels may facilitate moving the barbell support 20 30 while the barbell is loaded or unloaded with weight plates.

Additional embodiments of the barbell support are shown in FIGS. 3A, 3B, 3C and 3D. The embodiment of the barbell FIG. 3A comprises a single cradle 41 with a support 40 single pivot foot 46. The single cradle 41 is preferably sufficiently long to safely support and balance the barbell. The embodiment of the barbell support 40 comprises an extended support foot portion 44 of leverage handle 43 to provide lateral support.

Figure 3A:
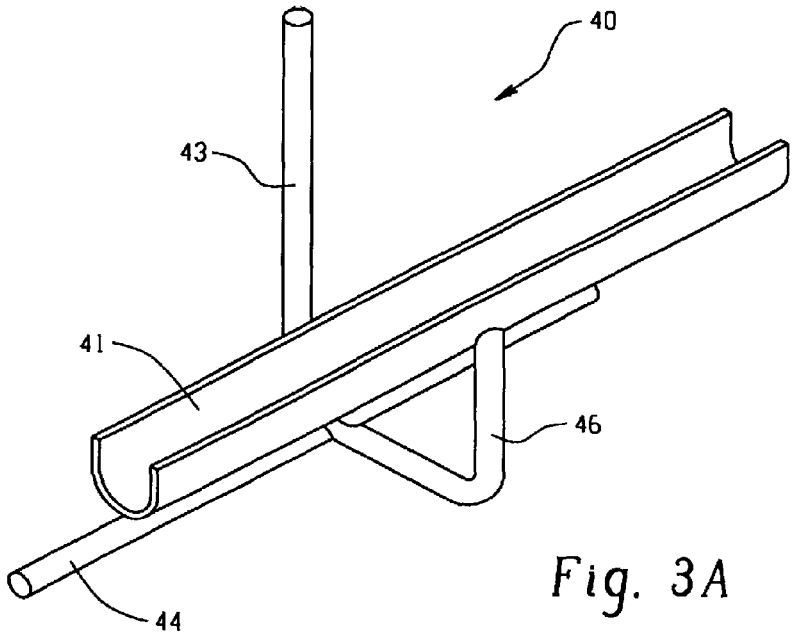
FIGS. 3A and 3B depict embodiments of the barbell support comprising a single cradle.
Figure 3B:
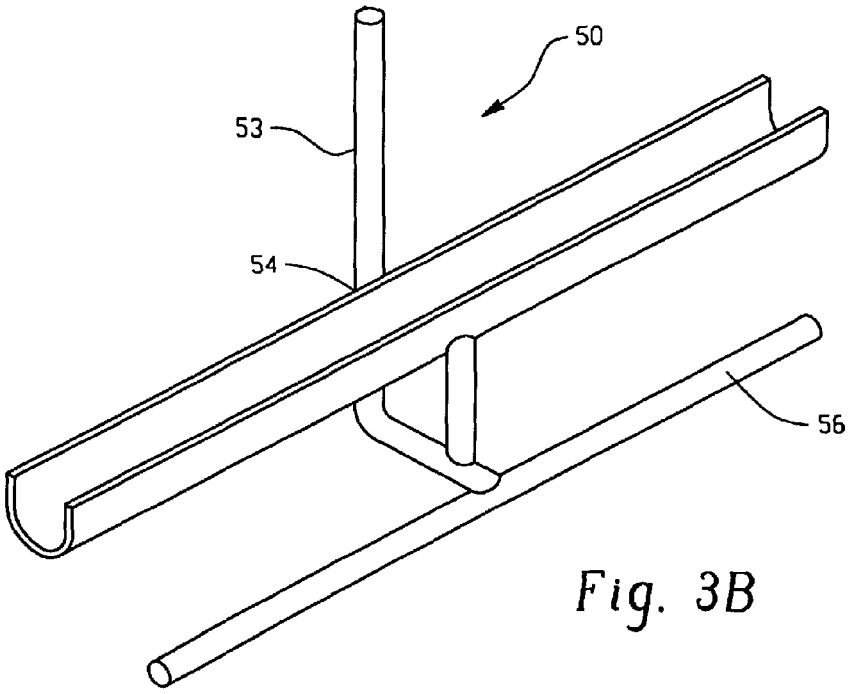

The embodiment of the barbell support of FIG. 3B is similar to the barbell support 40, except the pivot foot 56 is extended to provide lateral support and stability. The barbell support 50 also comprises a support foot portion 54 for leverage handle 53. A further embodiment of the barbell support may comprise both an extended foot support portion as shown in barbell support 40 and pivot foot as shown in barbell support 50.

Figure 3D:
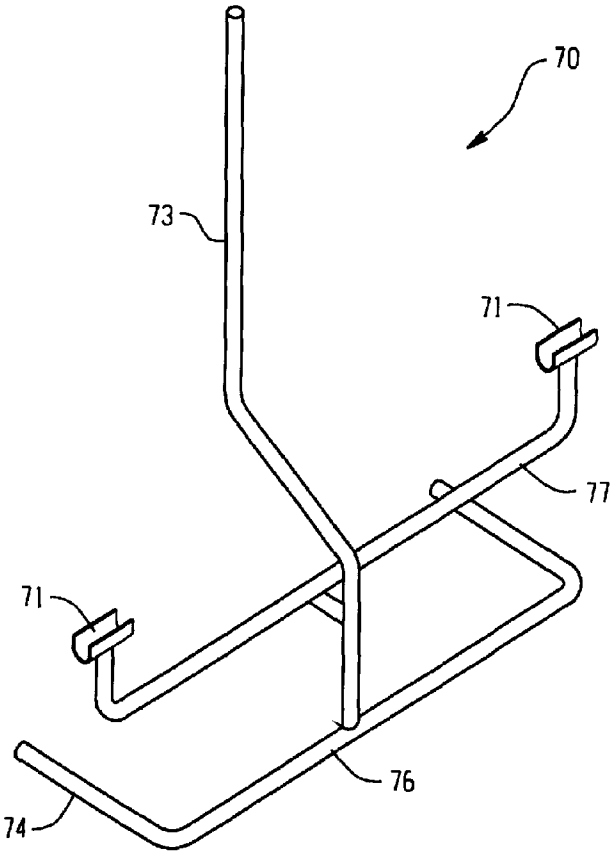
FIGS. 3C and 3D depict embodiments of the barbell support comprising a cradle or cradles attached directly or indirectly to the leverage handle.
Figure 3C:
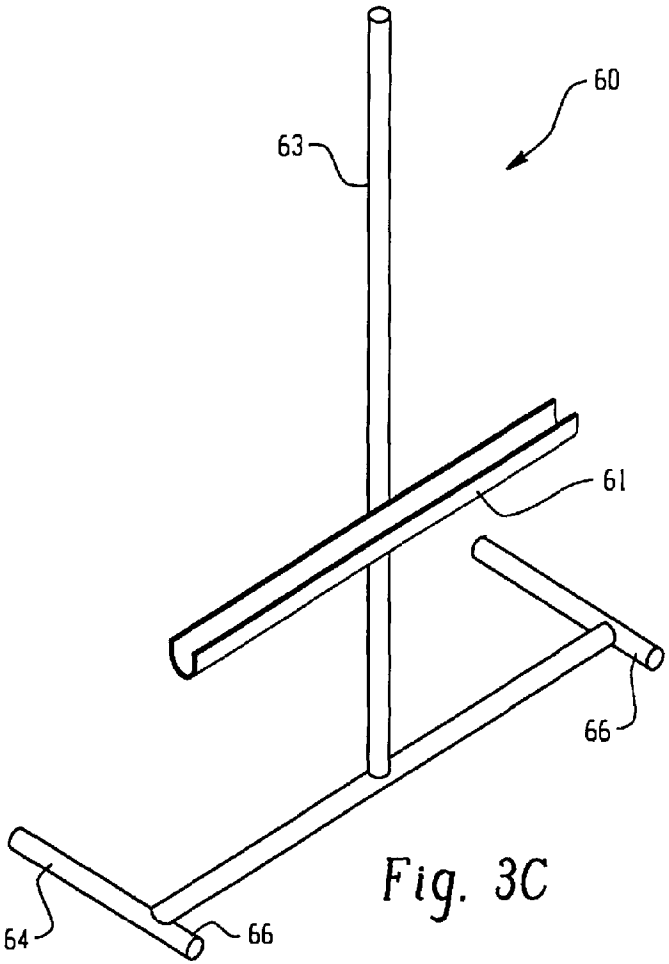
Figure 4B:
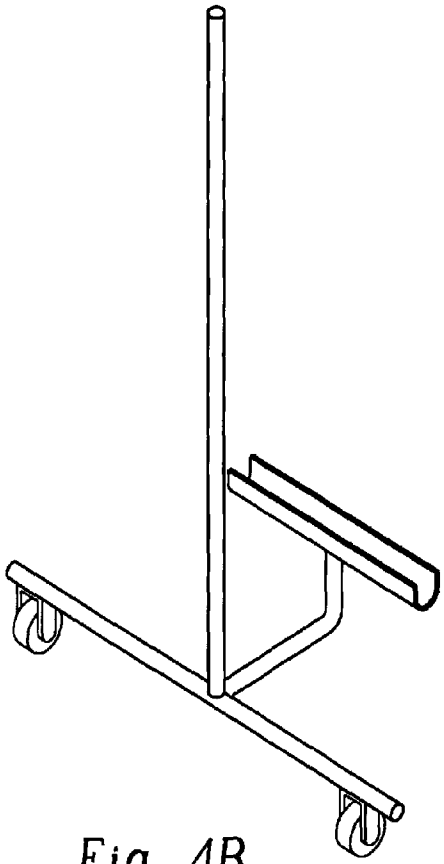
FIGS. 4A and 4B depict further embodiments of the barbell support comprising wheels.
Figure 4A:
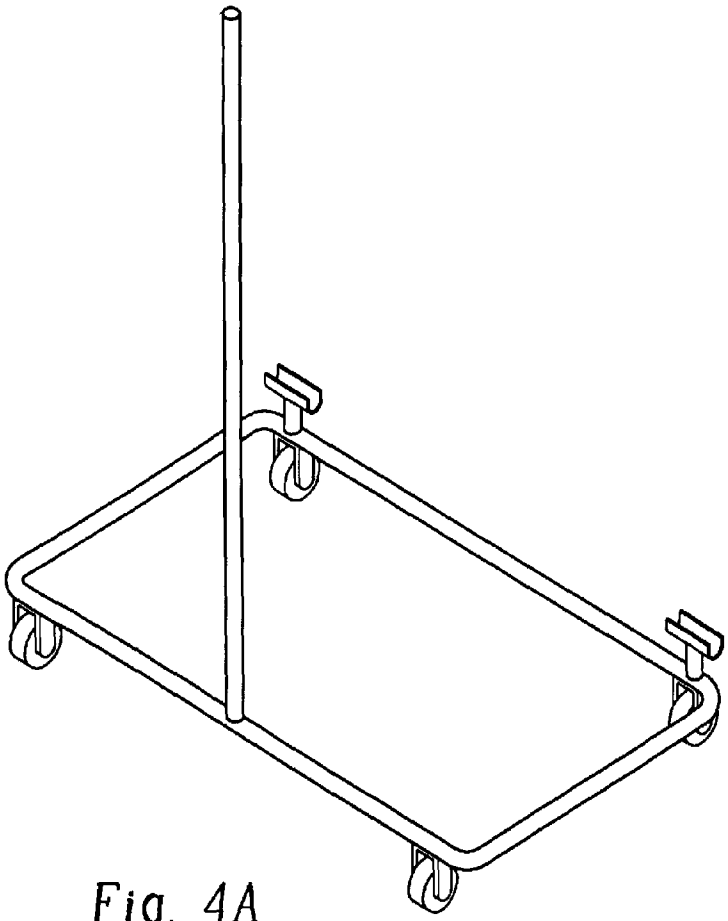

In the embodiments 60 and 70 of FIGS. 3C and 3D, the leverage handle is connected directly to the pivot foot and the cradle may be a single cradle 61 or multiple cradles 71 on a cradle support 77. In the embodiment of the barbell support 60 comprises a leverage handle 63 connected directly to the cradle 61. The barbell support 60 further comprises pivot feet 66 and support foot portion 64.

The embodiment of the barbell support 70 comprises a leverage handle 73 connected to a cradle support 77 supporting two cradles 71. The barbell support further comprises pivot foot 76 and support foot portions 74. Such embodiment may be more compact and more easily stored.

Embodiments of the barbell support may also comprise attachments or devices that assist in loading and/or lifting the barbell. For example, the embodiment of the barbell support 100 in FIG. 5 comprises a foot pedal 81. The foot pedal 81 may in conjunction with the leverage arm 82 to position the barbell support under the barbell and/or to lift the barbell after the barbell support is properly positioned. The foot pedal 81 allows a user to utilize their lower body and/or their own weight to help pivot the barbell into the raised position. Further embodiments of the barbell support 110 may comprise a jack. The jack may be a mechanical jack or a hydraulic system, for example. For example, an embodiment to the barbell support 110 may comprise a hydraulic jack 91, the hydraulic jack 91 may use a fluid, which is incompressible, that is forced into a cylinder by a pump plunger. Oil is typically used since it is self lubricating and stable. When the plunger pulls back by manipultor of the handle 92, it draws oil out of a reservoir through a suction check valve into the pump chamber. When the plunger moves forward, it pushes the oil through a discharge check valve into a hydraulic cylinder. The suction valve ball within the chamber opens with each draw of the plunger. The discharge valve ball is outside the chamber and opens when the oil is pushed into the cylinder. At this point the suction ball within the chamber is forced shut and oil pressure builds in the cylinder. This pressure may be used to lift the cradle 93. See FIG. 6. Various mechanical jacks may also be used such as scissor jacks or traditional car jack. Though various embodiments of the barbell support have been shown and described herein, various modifications may be made and additional combinations of the features shown and described herein are within the scope of the invention. A mechanical jack utilizes mechanical advantage to lift an object.

Embodiments of the invention also comprise methods of adding or removing a weight plate to a barbell. In certain embodiments, the method of adding or removing a weight plate to a barbell comprises sliding a cradle under a barbell comprising a weight plate, wherein the weight plate is resting on a floor. The method may further comprise leveraging the cradle with a handle attached to the cradle to raise the weight plates off the floor and removing or adding a weight plate from the barbell.

The embodiments of the described method and barbell support are not limited to the particular embodiments, method steps, and materials disclosed herein as such formulations, process steps, and materials may vary somewhat. Moreover, the terminology employed herein is used for the purpose of describing exemplary embodiments only and the terminology is not intended to be limiting since the scope of the various embodiments of the present invention will be limited only by the appended claims and equivalents thereof.

Therefore, while embodiments of the invention are described with reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

The invention claimed is:

1. A barbell support, comprising:

a cradle capable of receiving a barbell;

a leverage handle comprising a top end, a bottom end, a handle portion on the top end, and a support foot portion at the bottom end;

a pivot foot connected to a support leg extending vertically from the pivot foot supporting the cradle; and a floor engaging plane and the leverage handle extends 2 to 10 times further from the floor engaging plane than the support leg, such that the leverage handle provides a mechanical advantage in the range of 2 to 10 for lifting a weight in the cradle when pulling on the handle portion of the leverage handle.

2. The barbell support of claim 1, wherein the cradle is capable of supporting and balancing a barbell.

3. The barbell support of claim 1, wherein the pivot foot comprises a rounded bottom.

4. The barbell support of claim 1, wherein the leverage handle comprises a wheel.

* * * * *